United States Patent [19]

Kawasaki

[11] Patent Number: 4,685,372

[45] Date of Patent: Aug. 11, 1987

[54] VALVE UNIT FOR A BRASS MUSICAL INSTRUMENT

[75] Inventor: Kenzo Kawasaki, Shizuoka, Japan

[73] Assignee: Nippon Gakki Seizo Kabushiki Kaisha, Japan

[21] Appl. No.: 856,041

[22] Filed: Apr. 23, 1986

[30] Foreign Application Priority Data

Apr. 24, 1986 [JP] Japan ..... 60-060194[U]

[51] Int. Cl.[4] ..... G10D 9/04

[52] U.S. Cl. ..... 84/392; 84/390

[58] Field of Search ..... 84/387–393

[56] References Cited

U.S. PATENT DOCUMENTS 1,821,641 9/1931 Johnson ..... 84/388

FOREIGN PATENT DOCUMENTS 114573 10/1929 Austria ..... 84/390

*Primary Examiner*—Lawrence R. Franklin

*Attorney, Agent, or Firm*—Ostrolenk, Faber, Gerb & Soffen

[57] ABSTRACT

In construction of a single valve unit for a brass musical instrument having blow-in and blow-out tubes, and multiple resonant tubes, rotation and axial displacement of a piston in a cylinder switches communication between the blow-in and blow-out tubes and the resonant tubes. Compared with prior art double valve units, the present signal valve unit simplifies valve construction, avoids the need for phase adjustment, between two valves and reduces fatigue on the operator.

5 Claims, 11 Drawing Figures

VALVE UNIT FOR A BRASS MUSICAL INSTRUMENT

BACKGROUND OF THE INVENTION

The present invention relates to a valve unit for a brass musical instrument, and more particularly relates to an improvement in a construction for effecting selective switching of communication between a plurality of resonant tubes on a brass musical instrument such as a horn and, in particular, a triple horn.

A triple horn is provided with three resonant tubes different in length and selective switching of communication is effected between the three tubes in order to generate sounds of three different tonal pitches. One typical conventional construction effecting such switching of communication is of a type which is provided with a pair of valves driven for operation by a single lever in order to selectively communicate blow-in and blow-out tubes to one of the three tubes.

Such a double type valve unit, however, is accompanied with various drawbacks. Use of two sets of valves increases the weight of the entire valve unit while requiring a large number of parts. Phase adjustment in operation between the two valves requires troublesome maintenance. In addition, driving of the two valves via a single lever poses increased fatigue on the operator. Such drawbacks are further amplified when four or more resonant tubes are arranged on the brass musical instrument.

SUMMARY OF THE INVENTION

It is the object of the present invention to provide a lightweight valve unit which is simple in construction, requires no phase adjustment in operation and significantly reduces fatigue of the operator.

In accordance with the present invention, a piston is inserted into a cylinder in a rotatable and axially displaceable arrangement, a blow-in tube is connected to the mouthpiece, a blow-out tube is connected to a bell flare and N sets of resonant tubes, where N is an integer, different in length are all made to communicate with the interior of the cylinder accommodating the piston. (N-1) pairs of through holes are formed radially through the piston, each pair including two like through holes so that rotation of the piston communicates the blow-in and blow-out tubes with a selected one of (N-1) sets of resonant tubes. Axial displacement of the piston causes the blow-in and blow-out tubes to communicate with the remaining one of the resonant tubes.

DESCRIPTION OF THE PREFERRED EMBODIMENT

Figure 1:
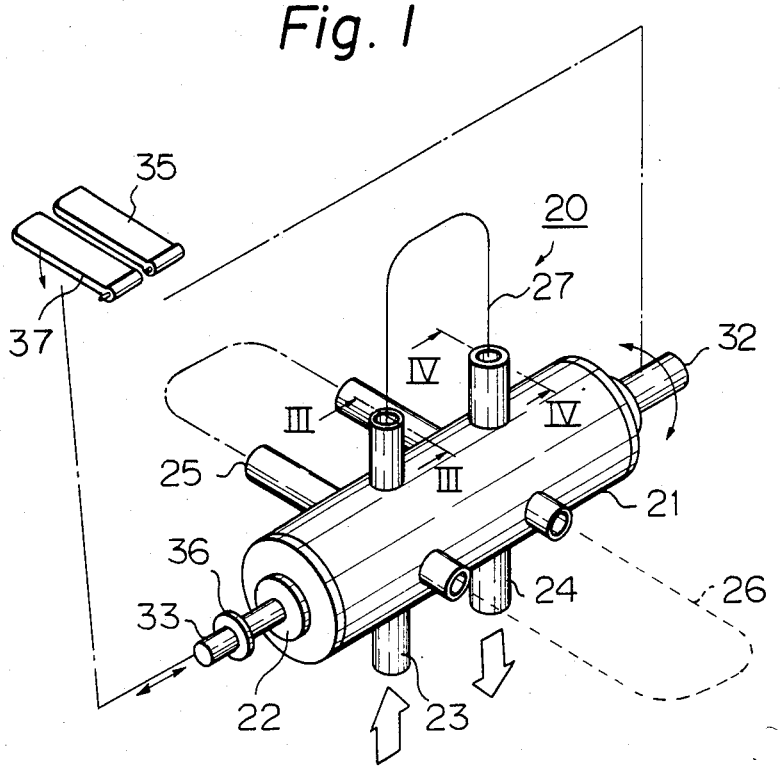
FIG. 1 is a perspective view, partly simplified, of one embodiment of the valve unit in accordance with the present invention.
Figure 2:
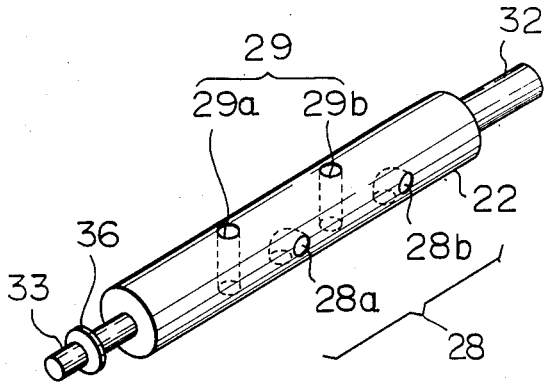
FIG. 2 is a perspective view of one embodiment of the piston usable for the valve unit shown in FIG. 1.

One embodiment of the valve unit in accordance with the present invention is shown in FIGS. 1 to 4, in which the valve unit 20 includes a tubular cylinder 21 and a piston 22 encased in an airtight manner in the cylinder 21 in an axially rotatable and reciprocal arrangement.

A blow-in tube 23 communicating with a mouthpiece (not shown) of the brass musical instrument, a blow-out tube 24 communicating with the bell flare of the brass musical instrument and the first, second and third resonant tubes 25, 26 and 27, respectively of different lengths are attached to the periphery of the cylinder 21. The blow-in and blow-out tubes 23 and 24 are spaced apart in the axial direction of the cylinder 21. At junctions with the periphery of the cylinder 21, the blow-in tube 23 and ends of the tubes 25 to 27 are offset from each other by 90°. More specifically, the blow-in tube 23 and the one end of the third tube 27 are offset from each other by 180° in axial alignment, the one ends of the first and second tubes 25 and 26 are offset from each other by 180° in axial alignment, the blow-out tube 24 and another end of the third tube 27 are offset from each other by 180° in axial alignment and the other ends of the first and second tubes 25 and 26 are offset from each other by 180° in axial alignment.

Two pairs 28 and 29 of through holes are formed in the piston 22 in arrangements normal to the axis of the piston 22 for selective communication with the blow-in and blow-out tubes 23 and 24 and the tube 25 to 27. The first pair 28 includes a pair of bent through holes 28*a* and 28*b* which are bent at right angles on the axis of the piston 22. The bent through holes 28*a* and 28*b* are spaced apart from each other in the axial direction of the piston over a distance equal to the space between the blow-in and blow-out tubes 23 and 24 on the cylinder 21.

The second pair 29 includes a pair of straight through holes 29*a* and 29*b* which extend across the axis of the piston 22. The straight through holes 29*a* and 29*b* of the second pair 29 are equally spaced from one bent hole 28*a* of the first pair 28. The distance between the pair of straight through holes 29*a* and 29*b* is equal to that between the pair of bent through holes 28*a* and 28*b*.

Shafts 32 and 33 extend axially outwards from both longitudinal ends of the piston 22. The shaft 32 is operationally coupled to the first lever 35 via a later described transmission so that it will be rotated over a prescribed angle when the first lever 35 is operated. The shaft 33 is circumferentially and concentrically provided with a circular stopper 36 so that when shaft 33 is axially moved by the second lever 37, as shown by the arrows in FIG. 5, stopper 36 will abut against the end of cylinder 21.

Figure 6A:
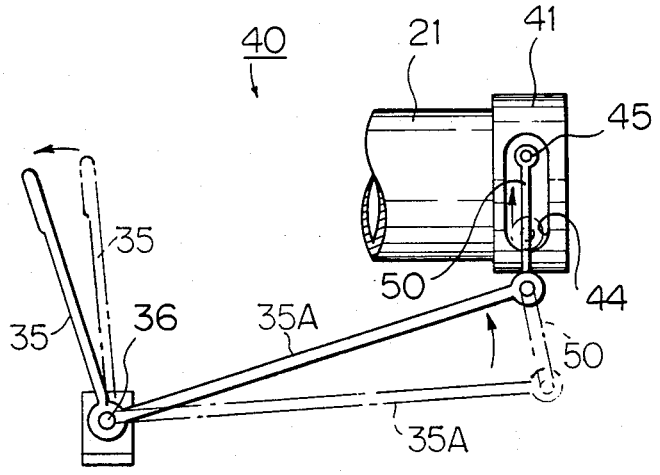
Figure 6B:
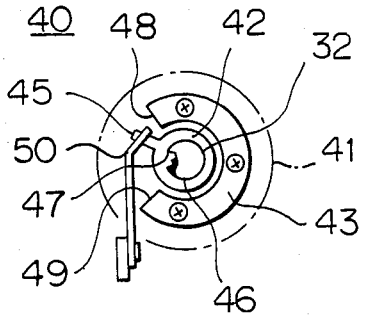

The transmission between the first lever 35 and the shaft 32 on the piston 22 is shown in FIGS. 6A and 6B. The transmission 40 includes a ring cap 41, a rotary base 42 and a C-shaped stopper 43. The cap 41 is coupled to the end of the cylinder 21 on the side of the shaft 32 while covering the shaft 32 and providing at its radial periphery a circumferential slot 44 extending in the direction of rotation of the rotary base 42. The rotary base 42 is provided with a connector pin 45 projecting radially outwards and a long projection 46 extending axially. This projection 46 is received within a long axial groove 47 formed in the periphery of the shaft 32 so that the shaft 32 is displaceable in the axial direction relative to rotary base 42, but they are locked together against relative rotation, i.e., shaft 32 and rotary base 42 rotate together. This rotary base 42 is inserted into an axial hole of the ring cap 41 and its connector pin 45 is received in the circumferential slot 44 in the ring cap 41. The stopper 43 is fixed by screws to the end of cylinder 21 on the side of the shaft 32 and its cutout faces the circumferential slot 44 in the ring cap 41. Rotation of the rotary base 42 is limited by abutment of its connector pin 45 against open ends 48 and 49 of the stopper 43 defining the above-described cutout. The first lever 35 in FIG. 1 is coupled in one body to a link 35*a* which is pivoted to the lower end of lever 50. The apex between the lever 35 and the link 35*a* is pivoted to a fixed pin 36. The top end of the lever 50 is pivoted to the connector pin 45 of the rotary base 42.

As the first lever 35 is moved as shown with an arrow in FIG. 6A from position A (shown in phantom) to position B, the lever 50 is rotated upwards and the rotary base 42 rotates clockwise as viewed from end 32 of piston 22, or counterclockwise as viewed from end 33 of the piston. This rotation of the rotary base 42 causes corresponding rotation of the shaft 32 and the piston 22 over 90°.

With such a construction of the valve unit 20 in FIG. 1, switching is carried out as follows.

Figure 3:
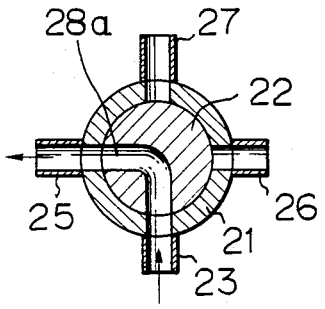
FIG. 3 is a section taken along a line III—III in FIG. 1.
Figure 4:
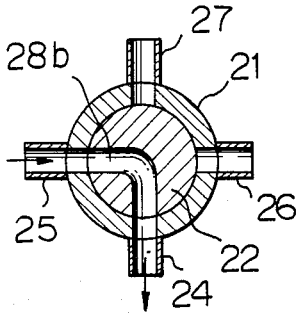
FIG. 4 is a section taken along a line IV—IV in FIG. 1.

In the normal state in which the first and second levers 35 and 37 are out of operation, the blow-in tube 23 communicates with one end of the first tube 25 via the bent through hole 28*a* in the piston 22 as shown in FIG. 3 and the blow-out tube 24 communicates with the other end of the first tube 25 via the bent through hole 28*b* in the piston 22 as shown in FIG. 4.

Figure 7:
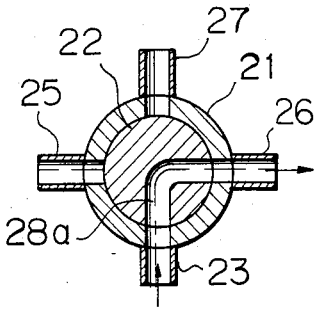
FIGS. 7 and 8 are transverse sectional views of the valve unit when the first lever is operated for rotation of the piston.
Figure 8:
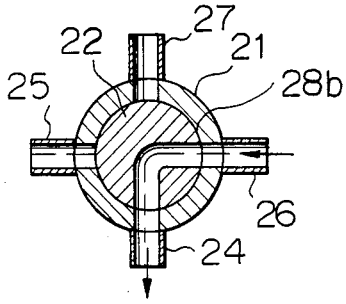

When the first lever 35 is operated, corresponding operation of the transmission 40 in FIG. 6A rotates the piston 22 counterclockwise over 90° as viewed from end 33 (FIG. 1) of piston 22. Then, the blow-in tube 23 communicates with one end of the second tube 26 via the bent through hole 28*a* and the blow-out tube 24 communicates with the other end of the second tube 26 via the bent through hole 28*b*. Thus, the communication is switched from the first to the second tube. This state is shown in FIGS. 7 and 8.

Figure 5:
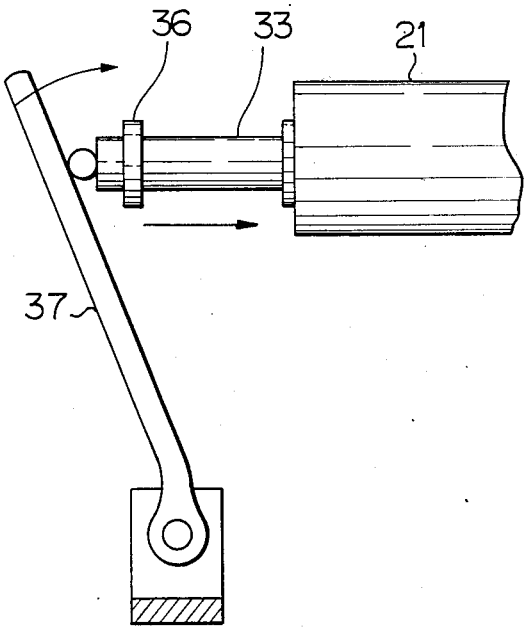
FIG. 5 is a side view of one end of the valve unit shown in FIG. 1, FIGS. 6A and 6B are side and end views of the transmission used for the valve unit shown in FIG. 1.
Figure 9:
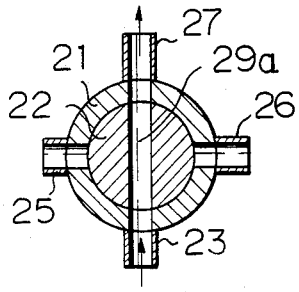
FIGS. 9 and 10 are transverse sectional views of the valve unit when the second lever is operated for axial displacement of the piston.
Figure 10:
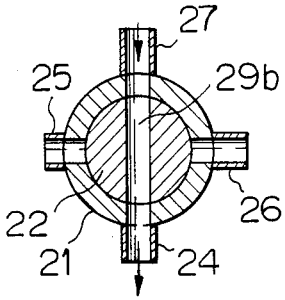

FIG. 5 shows an arrangement for moving piston 22 rightwards in FIG. 1. When the radial orientation of through holes 28*a* and 28*b* is as shown in FIGS. 3 and 4, movement of the second lever 37 in the direction shown by the arrows in FIG. 5 causes movement of the piston 22 rightwards in FIG. 1 until the stopper shown in FIGS. 1, 2, and 5 abuts against the corresponding end of the cylinder 21. Then, the bent through holes 28*a* and 28*b* are placed out of the position communicatable with the blow-in and blow-out tubes 23 and 24 and the communication is now taken over by the straight through holes 29*a* and 29*b*. More specifically, as shown in FIGS. 9 and 10, the blow-in tube 23 communicates with one end of the third tube 27 via the straight through hole 29*a* and the blow-out tube 24 communicates with the other end of the third tube 27 via the straight through hole 29*b*.

Since the valve unit of the present invention includes one set of piston and cylinder only, it has a very simple construction with a reduced number of parts. Greatly reduced power is required for operation of such a single type valve unit posing less fatigue on the operator. Further, use of the single type valve unit beneficially removes the need for inter-valve phase adjustment.

In the case of the illustrated embodiment, selective switching of communication is effected between three resonant tubes 25 to 27 different in length. But, with simple modifications obvious to one skilled in the art, the present invention is beneficially applicable to selective switching of communication between four or more resonant tubes. For example, when the valve unit is to be used for switching of communication between four resonant tubes, switching of communication between three resonant tubes may be effected by rotation of the piston and switching of communication to the other one may be effected by axial displacement of the piston 22.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

I claim:

1. A valve unit for a brass musical instrument provided with blow-in and blow-out tubes and N sets of resonant tubes, where N is an integer, comprising:

a cylinder having an axial bore communicating with said blow-in and blow-out tubes and said resonant tubes;

a piston inserted with an airtight fit into said axial bore in said cylinder, and provided with (N - 1) pairs of through holes formed radially therethrough, each pair including two through holes;

first means for driving said piston for rotation over a prescribed angle in order to make said blow-in blow-out tubes communicate with a selected one of (N - 1) sets of resonant tubes; and second means for driving said piston for axial displacement in order to make said blow-in and blow-out tubes communicate with the remaining one of said resonant tubes.

2. A valve unit as claimed in claim 1 in which said first driving means includes a first lever operationally coupled to said piston via a transmission.

3. A valve unit as claimed in claim 1 in which said second driving means includes a second lever operationally coupled to said piston via a transmission.

4. A valve unit as claimed in claim 1 in which selected ones of said through holes in said piston are straight in shape; and the remaining ones of said through holes are bent in shape by a prescribed angle about the axis of said piston.

5. A valve unit as claimed in claim 1 in which said brass musical instrument is provided with three sets of resonant tubes differing in length;

said piston is provided with two pairs of through holes;

said through holes of one pair are straight in shape; and said through holes of the other pair are bent in shape by 90° about the axis of said piston.

* * * * *